US005878616A

United States Patent [19]

Kulakov et al.

[11] Patent Number: 5,878,616

[45] Date of Patent: Mar. 9, 1999

[54] CENTERING PLUG FOR PIPE PRESS

[75] Inventors: Nikolay N. Kulakov; Valeri I. Sutormin; Nikolay D. Shanin, all of Budapest, Hungary

[73] Assignee: YBM Magnex, Inc., Newtown, Pa.

[21] Appl. No.: 724,453

[22] Filed: Oct. 1, 1996

[51] Int. Cl.[6] ..... B21C 23/20

[52] U.S. Cl. ..... 72/265; 72/368

[58] Field of Search ..... 72/255, 264, 265, 72/266, 272, 273, 368

[56] References Cited

U.S. PATENT DOCUMENTS

| | | | |
|---|---|---|---|
| 3,172,536 | 3/1965 | Cairns | 72/265 |
| 3,745,803 | 7/1973 | Livelsberger | 72/265 |
| 4,522,052 | 6/1985 | Doudet | 72/265 |
| 5,338,322 | 2/1995 | Simon | 29/252 |
| 5,666,846 | 9/1997 | Chen et al. | 72/273 |

FOREIGN PATENT DOCUMENTS

| | | | |
|---|---|---|---|
| 56-056720 | 5/1981 | Japan . | |
| 62-252611 | 11/1987 | Japan | 72/265 |
| 6-7835 | 1/1994 | Japan | 72/265 |
| 603456 | 4/1978 | U.S.S.R. | 72/265 |
| 606647 | 5/1978 | U.S.S.R. | 72/265 |
| 1694278 | 11/1991 | U.S.S.R. | 72/265 |

*Primary Examiner*—Joseph J. Hail, III
*Assistant Examiner*—Ed Tolan
*Attorney, Agent, or Firm*—Caesar, Rivise, Bernstein, Cohen & Pokotilow, Ltd.

[57] ABSTRACT

This invention relates to a method of extruding pipes on horizontal presses, and in particular relates to a method of extruding pipes wherein a removable centering plug is provided to prevent displacement of the central guide rod during the initial stages of pipe extrusion. The centering plug is adapted to fit around the guide rod and within the extrusion orifice. The centering plug is concentrically fitted within the extrusion orifice and is capable of being extruded through the extrusion orifice.

14 Claims, 5 Drawing Sheets

CENTERING PLUG FOR PIPE PRESS

FIELD OF THE INVENTION

This invention relates to a centering plug for use in a horizontal pipe press that prevents displacement of the central guide rod in the press during the initial stages of pipe extrusion, and further relates to a method of extruding pipes on horizontal presses wherein a centering plug is inserted into the extrusion orifice to prevent displacement of the central guide rod during the initial stages of pipe extrusion.

BACKGROUND OF THE INVENTION

Various types of pipe extrusion apparatuses are well known in the prior art. A typical prior art pipe extrusion apparatus is shown schematically in cross-section in FIG. 1. In that apparatus, the extrusion apparatus is a horizontal press shown generally at 10 that includes a horizontal press chamber 112 containing molding material in the form of fine granules or powdered materials 114 that are to be extruded through a target outlet or extrusion orifice 116 in an endplate 118 of the chamber 112. A guide rod 120 positioned coaxially with the longitudinal axis of the press chamber 112 and concentrically within the extrusion orifice 116 extends through the press chamber 112 and out the extrusion orifice 116. A piston member 122 having a piston endcap 124 thereon is positioned within the chamber 112 and surrounds the guide rod 120. When the piston member 122 moves through the press chamber 112 toward the endplate 118, the molding material 114 between the advancing piston endcap 124 and the endplate 118 is forced toward the endplate so that it fills the cavity 113 of the chamber 112 and extrudes through the extrusion orifice 116 around the guide rod 120 to form a pipe. The pipe formed by extruding the material through the orifice around the guide rod has an internal diameter essentially equal to the diameter of the guide rod 120.

While such an extrusion press is not very complex, there are significant drawbacks. In particular, such a press creates excessive variation in the thickness of the extruded pipe due to an upward displacement of the guide rod 120 in the extrusion orifice 116 during the initial stages of compacting the molding material. Early in the extrusion process, when the molding material 114 in the cavity 113 is pushed toward the endplate 118, as the piston member 122 moves toward the endplate 118, and before the molding material completely fills the cavity 113 within the chamber 112 between the piston and the endplate, the molding material initially located at the bottom of chamber is pushed upward against the guide rod 120, thereby causing the guide rod to dislocate from its concentric alignment within the extrusion orifice. When the guide rod 120 dislocates upward, the thickness of the wall of the pipe extruded therearound is no longer uniform. Upward displacement of the guide rod is shown by the arrow A in FIG. 1, and the dislocation of the guide rod causing the thickness of the pipe to vary is show by the different distances $\delta_1$ and $\delta_2$. In the cross-section of the pipe 127 shown in FIG. 2, the thickness of the pipe is not uniform, as again represented by the different wall thickness of $\delta_1$ and $\delta_2$. Once the guide rod is dislocated from its coaxially aligned position within the chamber 112 and its concentric position within the extrusion orifice 116, it is held in its new, non-concentric, non-aligned position due to the compaction of the molding material therearound at the endplate.

Dislocation of the position of the guide tube and the formation of a sidewall of non-uniform thickness is detrimental to the ultimate goal of producing a hollow pipe with a sidewall of uniform thickness.

OBJECTS OF THE INVENTION

In view of the above background and the inherent disadvantages of the prior art extrusion presses, it is an object of the present invention to provide a plug at the extrusion orifice of a press for extruding pipes that prevents the movement of a guide rod positioned within the orifice during the initial stages of extrusion.

It is an object of the invention to provide a cylindrical centering plug that fits sealingly within the extrusion orifice of the press and has a cylindrical opening therethrough that sealingly receives the distal end of the guide rod therein.

It is a further object of the invention to provide a centering plug of conical shape that fits into an extrusion orifice.

It is still another object of the invention to provide a centering plug not only with a conical-shaped outer surface, but also with a conical-shaped internal opening therethrough for receiving a correspondingly tapered conical end of a guide rod.

It is an object of the invention to provide a centering plug comprised of the same material as the material being extruded.

It is an object of the invention to provide a centering plug comprised of material having an ultimate stress limit higher that the material being molded, but which is compatible with the material being molded in terms of chemical composition.

It is also an object of the invention to provide a method of extruding pipes wherein the guide rod through the extrusion orifice is prohibited from any movement out of concentric orientation within the extrusion orifice during the initial stages of the extrusion process.

SUMMARY OF THE INVENTION

In an effort to overcome the drawbacks and deficiencies of the prior art horizontal extrusion presses wherein pipes are extruded that have a non-uniform sidewall, the present invention makes it possible to prevent movement of the guide rod that causes the guide rod to dislocate from its axially aligned position within the extrusion orifice, thereby decreasing the possibility of non-uniform formation of pipes extruded through the extrusion orifice around the guide rod. The present invention provides a centering plug adapted to fit around the guide rod and within the extrusion orifice that will retain the guide rod in its axially aligned position during the initial stages of extrusion. The centering plug is capable of being extruded through the extrusion orifice during the extrusion process.

In various embodiments of the invention, the centering plug is either a truncated conical shape having a central opening therethrough that is proportioned to fit around the distal end of a guide rod that extends into the extrusion orifice or cylindrically shaped, again with a central opening therethrough that fits around the end of the guide rod. The sidewall of the centering plug can be of uniform thickness, though that is not necessary. In still a third embodiment, the centering plug is formed as a cap that fits over the end of the guide rod the extrusion orifice. Each embodiment may also have the outer surface provided with groves therein.

The method of extruding pipe, particularly magnesium alloy pipes, of the present invention, utilizes an extrusion press, preferably a horizontal press, having a chamber with a cavity for containing molding material to be extruded, an extrusion orifice at one end the cavity, a piston within the cavity and movable toward the extrusion orifice, and a guide rod positionable within the extrusion orifice. The material to be molded is placed within the cavity. A centering plug designed to fit around the end of the guide rod is either positioned in the extrusion orifice and the guide rod inserted there into, or the centering plug is positioned around the end of the guide rod and the plug and guide rod are inserted into the orifice. When the guide rod and the molding material are positioned within the cavity, the piston is engaged and directed toward the extrusion orifice, compressing the molding material within the cavity. The pressure of the piston against the molding material causes the molding material to urge toward the extrusion orifice and when the pressure is sufficient, the centering plug, which is preferbly of the same material as the plug, is extruded through the extrusion orifice along with the olding material and becomes part of the pipe. Because the centering plug holds the guide rod securely within the center of the extrusion orifice until the plug is extruded through the orifice, the pipe that is extruded has a wall of uniform thickness that is not deformed because of pressure on the molding material dislocating the guide rod prior to extrusion of the molding material.

BRIEF DESCRIPTION OF THE DRAWINGS

Other objects and many of the attendant advantages of the present invention will be readily appreciated as the same becomes better understood by reference to the following detailed description when considered in conjunction with the accompanying drawings, wherein.

DETAILED DESCRIPTION OF THE PREFERRED EMBODIMENT

Figure 1:
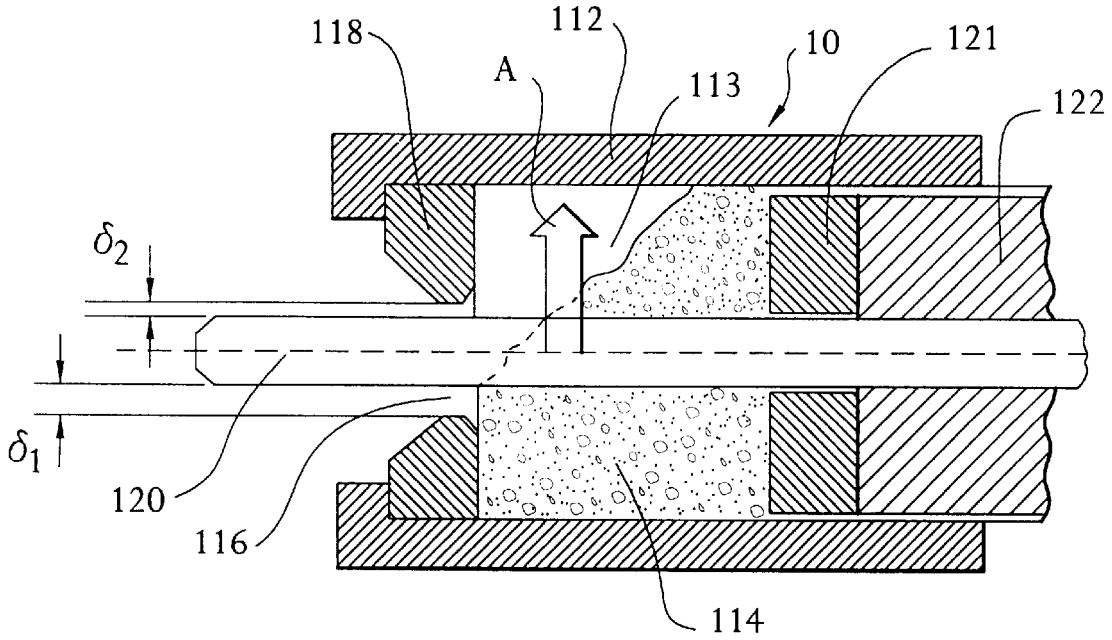
FIG. 1 is a schematic fragmentary cross-section view of a prior art horizontal press.
Figure 2:
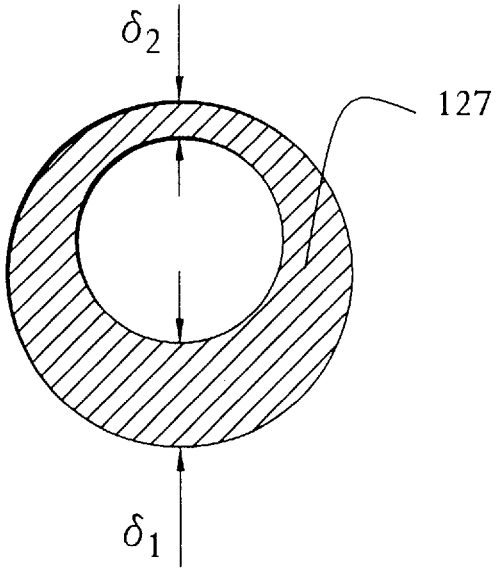
FIG. 2 is a cross-section view of a pipe produced by a prior art press taken long the line 2—2 of FIG. 1.
Figure 3:
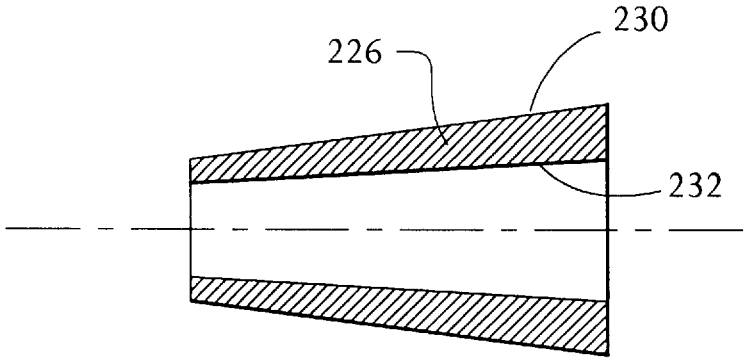
FIG. 3 is a schematic fragmentary cross section view of a centering plug for a horizontal press according to the present invention.
Figure 4:
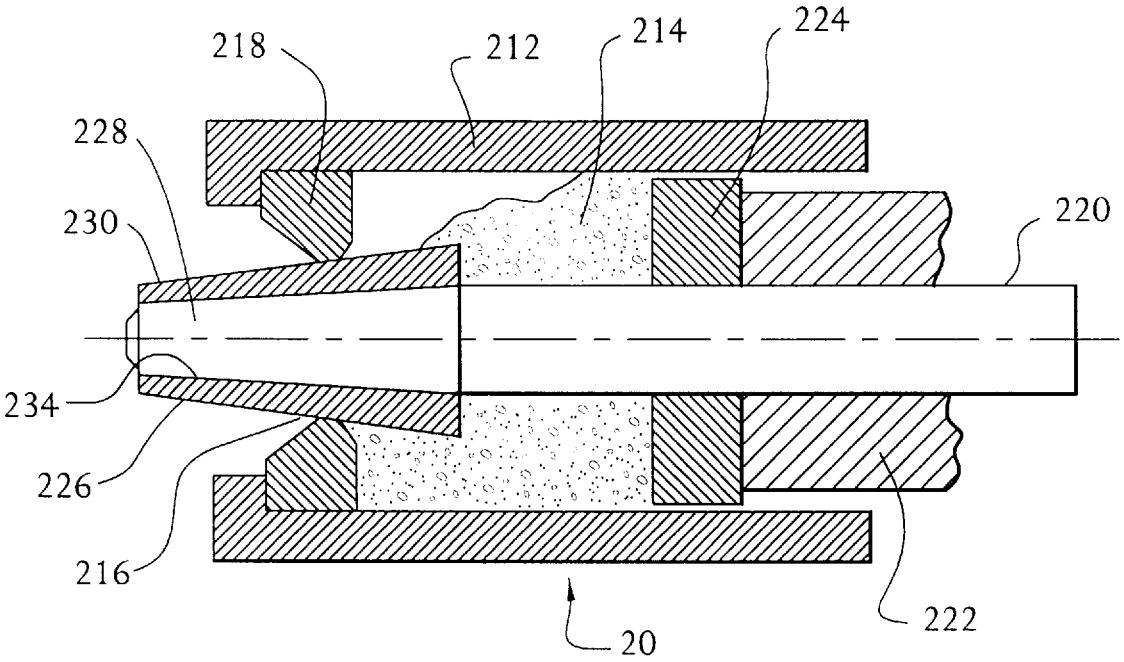
FIG. 4 is a schematic fragmentary cross-section view of a horizontal press with one embodiment of a centering plug of the present invention positioned therein.

Referring now in greater detail to the figures of the drawings wherein like reference characters refer to like parts, the centering ring and the improved pipe press of the present invention are shown schematically in FIGS. 3 and 4.

In the embodiment shown in FIG. 4, a typical horizontal press is shown generally at 20. Like the prior art, the press includes a horizontal press chamber 212 having a cavity 213 containing fine granules or powdered molding materials 214 that are to be compacted and extruded through a extrusion orifice 216 in an endplate 218 of the chamber 212. A guide rod 220 positioned coaxially with the longitudinal axis of the press chamber 212 and concentrcally within the extrusion orifice 216 extends through the press chamber 212, and out the extrusion orifice 216. A piston member 222 having a piston endcap 224 is contained within the chamber 212, is movable within the chamber and surrounds the guide rod 220. Unlike the prior art, however, the present invention includes a centering plug 226 positioned around the distal end 228 of the guide rod 220 within the extrusion orifice 216.

The purpose of the centering plug 226 is to seal the extrusion orifice 216 until the endcap 224 of the piston has forced the molding material completely around the guide rod 220 in the cavity 213 so that the guide rod is no longer capable of being moved from its axially aligned position by the force of the molding material as it is being urged toward the endplate 218 of the chamber 212. The guide rod is securely held in it axially aligned position within chamber 212 by the molding material compacted around it due to the pressure exerted by the moving piston. When sufficient pressure is exerted by the molding material against the centering plug, the plug is extruded outward through the orifice along with the molding material as part of the pipe as the pipe is being formed. The extruded end portion may subsequently be removed if desired.

Figure 5:
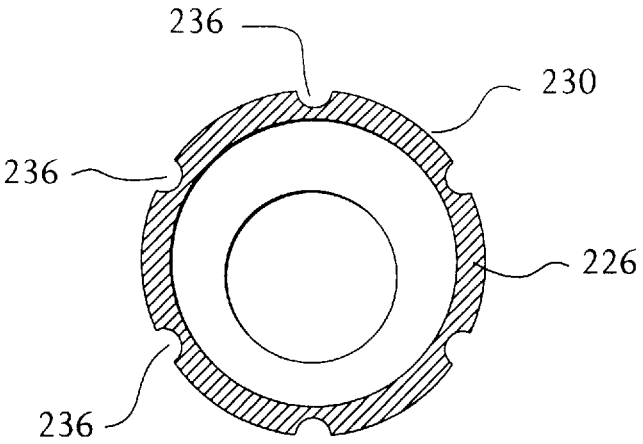
FIG. 5 is a cross-section of one embodiment of a centering plug of the present invention.

In a preferred embodiment, as shown in FIG. 4, the centering plug 226 has a conically tapered outer surface 230 that is tapered to fit through and seal the orifice 216 from the inside of the chamber 212. The plug 226 also has a conically shaped opening 232 therethrough coaxial with the longitudinal axis of the conical outer surface 230. Preferably, the distal end 228 of the guide rod 220 is formed with a conical taper 234 that corresponds to the conical opening 232 through the plug, so that the inside of the plug will fit snugly around the conical taper 234. In order to allow air within the chamber 212 to escape during the initial compression of the molding material caused by movement of the piston, when the centering plug is inserted into the extrusion orifice 216, the outer surface 230 of the plug can be provided with grooves or slots 236 thereon running the length of the plug. This embodiment of the plug is shown in cross-section in FIG. 5.

Figure 6:
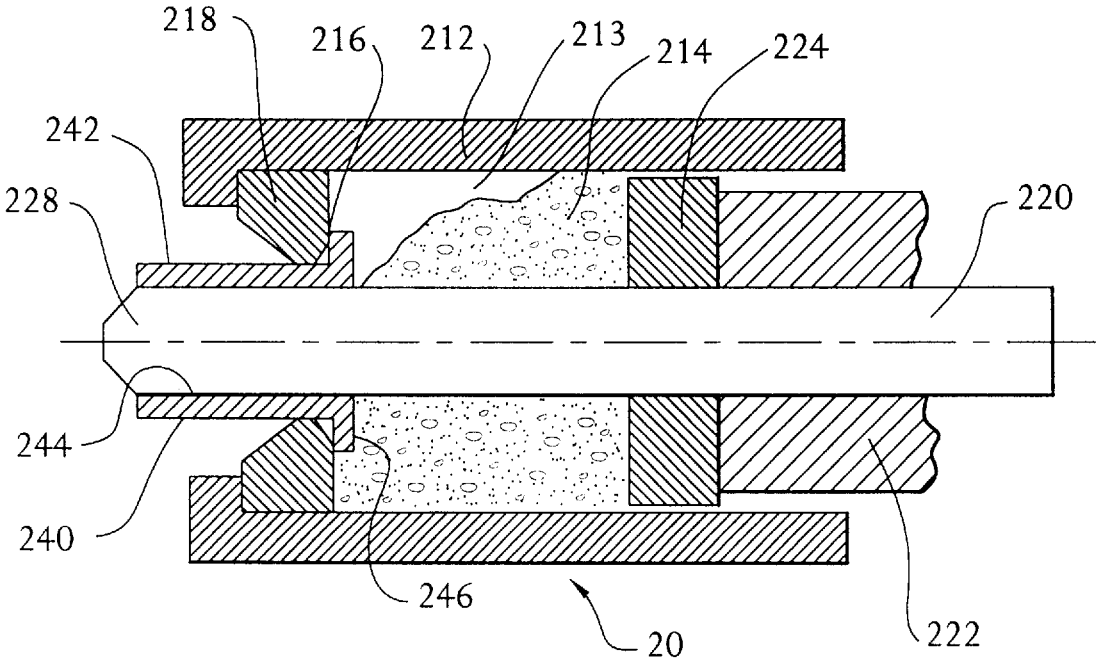
FIG. 6 is a schematic fragmentary cross-section view of a horizontal press with a second embodiment of a centering plug of the present invention positioned therein.

A second embodiment of the centering plug 240 is shown in FIG. 6. This centering plug 240 in this embodiment has a cylindrical shape with an outside diameter 242 of sufficient size to fit within the extrusion orifice 216. A cylindrical opening is provided therethrough of sufficient diameter 244 to fit snugly around the distal end 228 of the guide rod 220. In this instance, the distal end of the guide rod 220 need not be formed with a conical shape. To further insure a tight seal within the extrusion orifice 216, a bead or lip 246 can be formed around the outer edge of the centering plug on the inside of the chamber. Use and operation of this embodiment of the centering plug is the same as the conical shaped centering plug.

Figure 7:
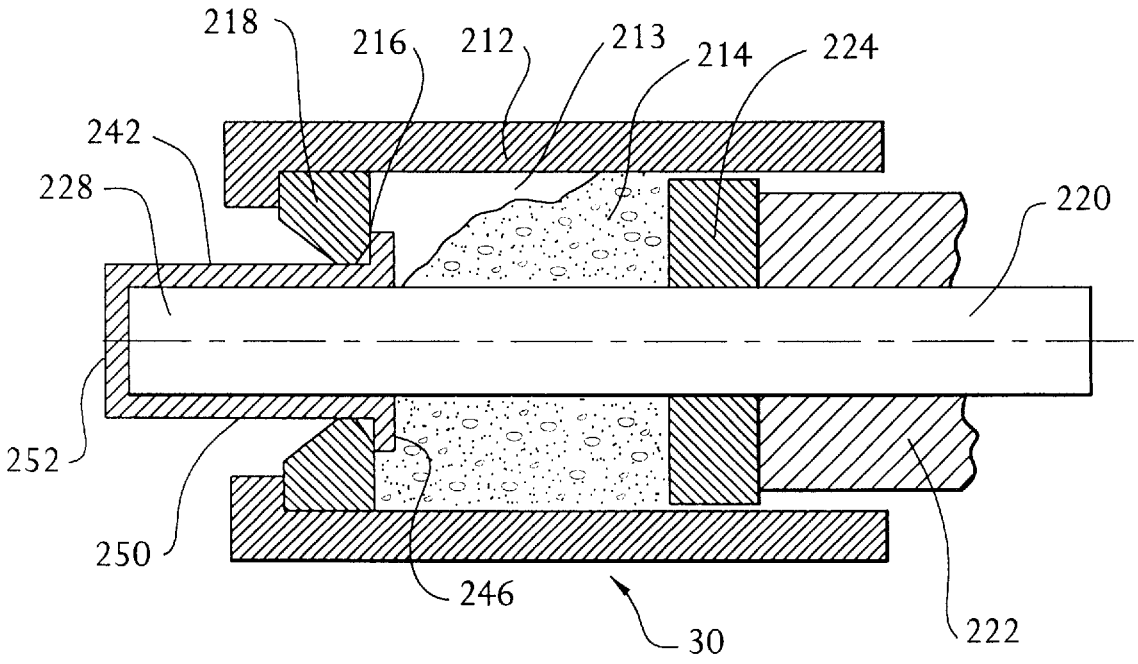
FIG. 7 is a schematic fragmentary cross-section view of a horizontal press with a third embodiment of a centering plug of the present invention positioned therein.

In still another embodiment of the centering plug of the invention is shown in FIG. 7. The centering plug 250 of this embodiment, rather that having an opening longitudinally therethrough, is formed with a solid end 252, whereby the plug becomes a cap that fits over the distal end 228 of the guide rod 220. Such a centering plug fits securely over the end 228 of the guide rod in order to maintain the coaxial and concentric positioning of the rod prior to extrusion and, like the previous embodiments, remains within the extrusion orifice until it is extruded with the molding material as part of the pipe. As an endcap, the centering plug can either be formed as a cylinder, similar to the embodiment shown in FIG. 6, with a wall of uniform thickness, or in a conical shape with a wall of uniform thickness, or in a conical shape with the inner and outer conical surfaces with different taper angles, similar to the embodiment shown in FIG. 4.

The centering plug is preferably made from the same material as the molding material 214. When the centering plug is selected from the same material which comprises the centering plug becomes the first segment of the extruded pipe and is coterminous with the pipe in terms of physical properties and structure. If, however, the yield limit of the molding material 216 is less than 150 Newton/mm$^2$, it is then preferable to manufacture the centering plug from a material with superior mechanical characteristics, but compatible with the molding material in terms of its chemical composition. For example, when magnesium-based light alloys comprise the molding material, the centering plug can be produced from high-strength aluminum alloys with magnesium additives.

In the following example, a centering plug of the type shown in FIG. 4 was made from magnesium-based molding material. The press chamber 212 had an internal diameter of 170 mm and the extrusion orifice opening 216 was 24 mm in diameter in the endplate. The guide rod had a diameter of 20 mm and was formed at its distal end 228 with a conical shaped taper having a taper ration of 1:20. The centering plug was provided with an inside conical taper 232 having a taper ratio of 1:20, corresponding to the taper 234 of the distal end of the guide rod, and an outside conical taper of 1:16. The centering plug was 40 mm in length, and the wall thickness at the middle cross-section was 2 mm. As stated previously, the centering plug was comprised of the same material as the molding material, namely a magnesium-based alloy. The centering plug was mounted onto the tapered distal end of the guide rod.

The press chamber was heated to 300° C. and the cavity 213 filled with 6 kgs of the fine granular magnesium alloy all of type AZM or AZ31. The guide rod with the centering plug fitted thereto was inserted all of the way into the orifice and secured therein with 300 Newtons of pressure. Thereafter, the endcap 224 of the piston member 222 was moved slowly through the cavity 213 to evenly distribute the alloy, which at the same time exerted pressure against the guide rod 220. Under the pressure of the piston urging against the alloy in the cavity and the heat of the chamber, the centering plug 226 was extruded through the orifice and the pipe alloy thereafter extruded at a rate of 2 m/min. The centering plug 226 was extruded as the front segment of the extruded pipe. The extruded pipe had a minimal variation in the wall thickness ranging from 0.05–0.2 mm.

While in the above example the centering plug was inserted onto the distal end of the guide rod prior to insertion into the orifice, it is also within the scope of the invention to insert the centering plug into the orifice and thereafter insert the guide rod into the centering plug.

The use of the centering plug of the present invention allows the very precise extrusion of pipes on horizontal extrusion presses, especially when the pipes are extruded from granules and powders. The invention, however, is not limited to extruding pipes from such materials. For example, the centering plug may also used in conjunction with extrusion from ingot material. When ingot material is extruded, the ingots can be hollowed, and the guide rod inserted therethrough. Under these circumstances, the centering plug can be inserted into the extrusion orifice and the rod thereafter inserted into the plug. Once the pressure is applied to the ingot, the centering plug will be extruded prior to the extrusion of the ingot alloy material. In instances where extrusion has been of ingot material in conjunction with a centering plug in the extrusion orifice, it has been found that the variation in wall thickness of the extruded pile is from 0.06–0.15 mm.

Without further elaboration, it is believed that the foregoing so fully illustrates the present invention that others may, by applying current or future knowledge, apply the same for use under various conditions of service.

We claim:

1. A device for retaining a guide rod within an extrusion orifice of a horizontal press, said device comprising a centering plug adapted to fit around the guide rod and within the extrusion orifice, said centering plug halving longitudinal axis, an outer surface, at least one groove in said outer surface, and being capable of being extruded through the extrusion orifice.

2. A device as claimed in claim 1, wherein said centering plug has a circular cross-section transverse to the longitudinal axis.

3. A device as claimed in claim 2, wherein said centering plug is conical and has a opening therethrough.

4. A device as claimed in claim 3, wherein said centering plug has a sidewall of uniform thickness.

5. A device as claimed in claim 3, wherein said opening through said plug is conically shaped and has a longitudinal axis axially aligned with the longitudinal axis of said plug.

6. A device as claimed in claim 5, wherein said conical opening has first and second ends, and one of said ends is closed.

7. A device as claimed in claim 2, wherein said centering plug is cylindrical and has an opening therethrough.

8. A device as claimed in claim 7, wherein said centering plug has a sidewall of uniform thickness.

9. A device as claimed in claim 7, wherein said opening through said plug is cylindrically shaped and has a longitudinal axis axially aligned with the longitudinal axis of said plug.

10. A device as claimed in claim 9, wherein said opening through said plug has first and second ends, and one of said ends is closed.

11. A method of extruding a hollow pipe from a horizontal press having a chamber with a cavity for containing molding material to be extruded, an extrusion orifice at one end of the cavity, a piston within the cavity and movable toward the extrusion orifice, and a guide rod positionable within the extrusion orifice, said method comprising the steps of:

inserting molding material into the cavity of the chamber;

positioning a centering plug having an outer surface with at least one groove in the outer surface around the distal end of the guide rod;

positioning the centering plug and the guide rod combination securely within the extrusion orifice;

causing the piston to compress against the molding material within the cavity until the molding material urges the centering plug to be extruded through the extrusion orifice along with the molding material.

12. A method as claimed in claim 11, wherein said centering plug is comprised of the same material as the molding material.

13. A method as claimed in claim 11, wherein the centering plug positions the guide rod a uniform distance from the sidewall of the extrusion orifice.

14. A method of extruding a hollow pipe from a horizontal press having a chamber with a cavity for containing molding material to be extruded, an extrusion orifice at one end of the cavity, a piston within the cavity and movable toward the extrusion orifice, and a guide rod positionable within the extrusion orifice, said method comprising the steps of:

positioning a centering plug having an outer surface with at least one groove in the outer surface around the distal end of the guide rod;

positioning the centering plug and the guide rod combination securely within the extrusion orifice;

inserting molding material into the cavity of the chamber after the centering plug and guide rod are positioned in the extrusion orifice;

causing the piston to compress against the molding material within the cavity until the molding material urges the centering plug to be extruded through the extrusion orifice along with the molding material.

* * * * *